US012397395B2

(12) United States Patent
Barbier et al.

(10) Patent No.: US 12,397,395 B2
(45) Date of Patent: Aug. 26, 2025

(54) CHAMFERING DUST HOOD EXTENSION DEVICE AND ADAPTER

(71) Applicant: Hilti Aktiengesellschaft, Schaan (LI)

(72) Inventors: Lionel Barbier, Munich (DE); Matthias Mazur, Hamburg (DE); Paul Fally, Hamburg (DE)

(73) Assignee: Hilti Aktiengesellschaft, Schaan (LI)

( * ) Notice: Subject to any disclaimer, the term of this patent is extended or adjusted under 35 U.S.C. 154(b) by 502 days.

(21) Appl. No.: 17/435,302

(22) PCT Filed: Feb. 25, 2020

(86) PCT No.: PCT/EP2020/054869
§ 371 (c)(1),
(2) Date: Aug. 31, 2021

(87) PCT Pub. No.: WO2020/178072
PCT Pub. Date: Sep. 10, 2020

(65) Prior Publication Data

US 2022/0203499 A1 Jun. 30, 2022

(30) Foreign Application Priority Data

Mar. 4, 2019 (EP) ..... 19160445

(51) Int. Cl.
*B24B 55/10* (2006.01)
*B24B 23/02* (2006.01)

(52) U.S. Cl.
CPC ..... *B24B 55/102* (2013.01); *B24B 23/02* (2013.01)

(58) Field of Classification Search
CPC ..... B24B 23/00; B24B 23/005; B24B 23/08; B24B 23/02; B24B 5/35; B24B 5/36; B24B 55/052; B24B 55/102; B24B 55/06; B24B 55/04; B24B 9/007; B24B 9/02; B24B 9/04; B24B 9/06; B24B 9/08; B24B 9/18;

(Continued)

(56) References Cited

U.S. PATENT DOCUMENTS 3,882,644 A * 5/1975 Cusumano ..... B24B 55/102 451/359
5,445,438 A * 8/1995 Drumm ..... A46B 13/005 15/183

(Continued)

FOREIGN PATENT DOCUMENTS

CN 101631637 A 1/2010
CN 102554794 A 7/2012

(Continued)

OTHER PUBLICATIONS

PCT/EP2020/054869, International Search Report dated Jun. 2, 2020 (Two (2) pages).

*Primary Examiner* — Eric J Rosen
*Assistant Examiner* — John C Merino
(74) *Attorney, Agent, or Firm* — Crowell & Moring LLP

(57) ABSTRACT

A dust hood extension device for use with a dust hood of a grinder includes a supporting device where the supporting device is configured to surround the dust hood and an opening defined by the dust hood extension device. The opening is arranged eccentrically with respect to a central axis of a drive shaft of the grinder in a fastened condition of the dust hood extension device on the dust hood of the grinder.

8 Claims, 4 Drawing Sheets

(58) Field of Classification Search
CPC ..... B23Q 9/0028; B23Q 3/18; B25F 3/00; B23D 21/08
See application file for complete search history.

(56) References Cited

U.S. PATENT DOCUMENTS

| | | | | |
|---|---|---|---|---|
| 5,545,082 | A | 8/1996 | Courson et al. | |
| 6,053,806 | A | 4/2000 | Ohlendorf | |
| 6,375,557 | B1 | 4/2002 | Spangenberg et al. | |
| 8,998,685 | B2 | 4/2015 | Klabunde et al. | |
| 9,101,993 | B2 | 8/2015 | Yokota et al. | |
| 2008/0171501 | A1* | 7/2008 | Woods | B24B 55/102 451/451 |
| 2009/0061749 | A1* | 3/2009 | Sunderland | B24B 23/005 451/438 |

FOREIGN PATENT DOCUMENTS

| | | | |
|---|---|---|---|
| CN | 206982333 | U | 2/2018 |
| DE | 10 2008 045 203 | A1 | 3/2010 |
| EP | 0 916 453 | A2 | 5/1999 |
| EP | 1 053 829 | A1 | 11/2000 |
| EP | 1 321 230 | A1 | 6/2003 |

* cited by examiner

CHAMFERING DUST HOOD EXTENSION DEVICE AND ADAPTER

BACKGROUND AND SUMMARY OF THE INVENTION

The present invention relates to a dust hood extension device for use in combination with a dust hood for a grinder, and to a system comprising a dust hood extension device of this kind and an adapter. In particular, the dust hood extension device is characterized in that an opening of the device is arranged eccentrically in relation to the central axis of the drive shaft.

For grinding flat surfaces, handheld electric power tools, e.g., grinders, such as angle grinders, are known in the prior art. These usually have an inserted tool, which can preferably be designed as a grinding means. In general, the grinding means is matched to the surface to be machined and can, for example, be a cup wheel, which has segments with a diamond matrix, for example. As is known, dust is formed during the grinding of the surface to be machined, and, in many cases, this dust may be hazardous to health and/or toxic to humans, especially to the operator of the grinder. In particular, the dust formed during grinding should not be inhaled and enter the airways of the operator of the grinder. To avoid this, "dust hoods" are known in the prior art which can be arranged around the grinding means and are designed to catch or receive the dust formed during grinding. Conventional dust hoods are used to avoid dust spreading during grinding work in order to protect the health of a user of the grinder. Conventional dust hoods of this kind can preferably be connected to a vacuum cleaning device, such as a vacuum cleaner or a dust collector, wherein the vacuum cleaning device produces a vacuum to generate an air flow by means of which the dust can be sucked out of the region of the dust hood.

It has been found that the dust hoods known in the prior art deliver good dust removal results especially when the corresponding grinders to which the dust hoods are connected are used for machining flat surfaces. Good suction performance in relation to the dust formed during grinding work is achieved, in particular, if the dust hood rests flat on the surface to be machined. When machining such flat surfaces, an opening of the dust hood rests substantially fully on the surface on which the dust is formed, and therefore the dust can be collected in an optimum manner by the dust hood and removed by the vacuum cleaning device.

However, it has been found that the dust hoods known in the prior art can collect and remove only a small proportion of the dust formed especially when the surface to be ground is smaller than the diameter of the dust hood, which usually has a substantially circular surface area. This disadvantage of conventional dust hoods is particularly evident when the intention is to produce or grind chamfers since the chamfers are generally of significantly narrower design than the diameter of a dust hood. If the intention is to grind a chamfer or to form a chamfer by grinding, a conventional dust hood generally no longer covers a sufficiently large proportion of the surface to be machined to ensure effective removal of the dust formed.

Solutions for collecting dust which is formed during the grinding of chamfers are known in the prior art. However, these conventional solutions are often impractical for the operator of the grinder and are not suitable for everyday use and use on construction sites for various reasons. For example, hollow cuboidal devices are known, these generally consisting of sheet metal or thin metal plates, in which the grinding process can take place. However, with these cuboidal devices, the operator of the grinder is in practice unable to see the grinding process since, on account of the metallic material used, the view of the grinding location, in particular the chamfer to be produced, is restricted or possibly even entirely obscured. Moreover, such a proposed cuboidal device is often very heavy owing to the metallic material, and therefore it can be used to only a limited extent precisely in the case of relatively long grinding operations, e.g., when chamfers for a staircase are to be produced or when using large grinders. In addition, the proposed cuboidal devices often have an awkward, bulky shape, and therefore they can be operated only with difficulty precisely by small users, who may be lacking in physical strength. Furthermore, with the solutions proposed, it is not easy to change between the grinding of edges, chamfers and/or (flat) surfaces since the cuboidal devices generally comprise a substantially rectangular aperture, which, while it allows the production of chamfers, does not allow the machining of smooth and flat surfaces. In addition, the virtually complete envelopment of the grinding zone makes easy changing of the grinding means impossible. Vertical adjustment is possible only by the laborious and involved process of unscrewing connection means, e.g., wing nuts. Furthermore, the opening of the cuboidal device proposed in the prior art for receiving the dust formed during grinding is arranged centrally in relation to a central or rotation axis of the drive shaft of the grinder, and this often leads to tilting of the system and to suboptimal grinding results.

In the case of known grinders with a conventional dust hood, the bearing surface of the grinder on the surface of a chamfer to be ground is generally significantly smaller than the surface of the grinding means itself, and therefore large quantities of the dust formed can escape upward and downward. Disadvantageously, only a small quantity of the dust particles released remains in the dust hood for extraction or removal from the region of the dust hood with the aid of a vacuum cleaning device.

It is an object of the present invention to overcome the disadvantages described above of conventional dust hoods and to provide an extension device for a dust hood which offers improved suction removal behavior for the dust formed during grinding work, especially if chamfers are to be produced with the grinder. In particular, the device to be provided should allow simple handling and easy exchange of the grinding means of the grinder. Moreover, it would be desirable if the extension device to be provided ensured simple changeover between the machining of flat surfaces and the grinding of chamfers and edges, allowed uncomplicated vertical adjustment and did not tend toward tilting.

The object is achieved by the subject matter of the independent claims. Advantageous embodiments of the subject matter of the independent claims can be found in the dependent claims.

The object is achieved by a dust hood extension device for use in combination with a dust hood for a grinder, wherein the grinder comprises a drive shaft for driving a grinding means, wherein the grinding means rotates in a rotationally symmetrical manner around a central axis of the drive shaft during operation. The dust hood extension device is characterized in that it comprises a supporting device and an opening, wherein the supporting device is designed to surround the dust hood and to collect any dust particles which emerge, wherein the opening is arranged eccentrically in relation to the central axis of the drive shaft.

By means of the invention, a technical solution is provided which advantageously enables the user to produce or re-grind chamfers with particularly little dust. Moreover, with the provided dust hood extension device it is possible to alternate between the various grinding scenarios in a simple, rapid and uncomplicated manner. According to the invention, the term "grinding scenarios" preferably refers to different grinding situations, such as the grinding of (flat) surfaces or the production of chamfers, i.e., work on work locations with edges. The advantageous shaping of the supporting device allows material-saving production of the provided dust hood extension device. A low weight of the device and thus easier handling of the provided dust hood extension device in comparison with conventional solutions is thereby advantageously achieved. According to the invention, it is preferred that the supporting device is referred to as the basic support.

According to the invention, it is preferred that the grinding means of the grinder comprises a segmented ring, which is preferably arranged around the rotation axis. The segmented ring preferably comprises individual grinding segments, which together form an annular device as a segmented ring. According to the invention, these grinding segments are preferably also referred to as rotational segments. In a region adjacent to the rotation axis, the segmented ring is at an inner distance from the rotation axis and, in a region away from the rotation axis, it is at an outer distance to the rotation axis. According to the invention, it is preferred that the supporting device of the dust hood extension device has an opening, wherein this opening of the supporting device is arranged eccentrically. According to the invention, the term "eccentric arrangement" in relation to the rotation axis preferably means that the opening is arranged above the rotational segments or above the segmented ring, for example. The eccentric arrangement of the opening of the dust hood extension device or of the supporting device is particularly advantageous since the dust formed during grinding can be sucked out of the dust hood directly where it is formed in the region of the rotational segments if the dust hood is connected to a vacuum cleaning device. By virtue of its configuration and shape, the supporting device helps to ensure that substantially the entire vacuum suction flow produced by the vacuum cleaning device is guided through the opening of the dust hood extension device or supporting device. It is thereby advantageously possible to achieve improved removal of the dust forming in the entire region of the grinding means.

In one exemplary embodiment of the invention, it is preferred that the opening of the dust hood extension device or basic support is arranged eccentrically with respect to a central axis of the drive shaft, wherein, according to the invention, the central axis of the drive shaft is preferably also referred to as the rotation axis. Thus, the opening of the supporting device or adapter is preferably also positioned eccentrically with respect to the axis of the inserted tool or grinding means, e.g., the segmented grinding ring. By means of the eccentric arrangement it is possible to achieve a significantly improved grinding behavior in comparison with conventional grinders since, in contrast to a central arrangement, a larger region of the grinding disk is in engagement with the underlying surface to be ground. It is thereby possible, in particular to prevent tilting of the grinding means and/or of the inserted tool in a particularly effective manner. Moreover, more efficient machining of the underlying surface is possible since a larger area of the grinding disk is in contact or in engagement with the underlying surface.

The supporting device of the provided dust hood extension device is preferably designed so as to be able to fit on a dust hood, i.e., to be mounted on a dust hood. In particular, the supporting device is designed to re-close any openings which may form during the grinding of chamfers, with the result that the dust forming during grinding is effectively prevented from escaping from the region of the dust hood and of the grinder. On the contrary, the dust forming during the grinding of chamfers can be removed substantially completely by virtue of the provided dust hood extension device, and therefore no longer represents a risk to the health of the operator. This advantage of the invention is achieved, in particular, by virtue of the fact that substantially the entire air flow produced as a suction flow by a vacuum cleaning device is guided through the openings of the dust hood extension device by virtue of the closure of the openings by the supporting device of the dust hood extension device. Unwanted emergence from the system of the dust produced during the grinding process is thereby avoided in an effective manner. According to the invention, it is very particularly preferred that it should be possible for the dust hood to be connected to a vacuum cleaning device, thus enabling the dust which forms during grinding with the grinder to be removed in a particularly simple, rapid and direct manner. Through the prompt removal of the dust from the work zone of the grinder, the risk to the health of the operator of the grinder and surrounding workers is considerably further reduced.

In one embodiment of the invention, it is preferred that the dust hood extension device comprises a clip for tool-free fastening on the dust hood. By virtue of the tool-free mounting of the dust hood extension device on the dust hood, the handling of the dust hood extension device is made significantly easier because there is no need to carry an additional tool to use the dust hood extension device together with a grinder and a dust hood. According to the invention, it is preferred that the provided dust hood extension device or basic support is of such flexible design in the region of the clip or comprises a flexible material such that a clip mechanism for tool-free fastening on the dust hood is made possible. In this case, the material of the clip is just sufficiently flexible to enable the clip to be moved slightly backward without breaking off but also so stiff and/or strong that it moves back in the direction of the basic support of the dust hood extension device during fastening in order to ensure an effective connection between the dust hood extension device and the dust hood. The clip joint obtained is preferably releasable when required, enabling the grinder to be removed, cleaned and/or serviced easily. In particular, the tool-free fastening of the dust hood by means of a clip on the dust hood extension device enables the user of the grinder to change back and forth between chamfer and surface grinding in a particularly simple, uncomplicated and effortless manner. In further preferred embodiments of the invention, however, it is also possible for other fastening options, e.g., screw fastening or joints formed by frictional engagement, to be provided. This preferably applies both to the joint between the dust hood and the dust hood extension device and to the joint between the dust hood and the adapter.

In another embodiment of the invention, it is preferred that the supporting device can be mounted rotatably on the dust hood. In other words, it is preferred according to the invention if the basic support is mounted rotatably on the existing dust hood. This provides the advantage that the user can turn the grinder to a position that is optimal for the user. This enables the grinder to be adapted individually to the respective physical requirements of different users, thus, on the one hand, making work with the grinder simpler and more comfortable and, on the other hand, preventing physical injury due to incorrect posture or the like.

According to the invention, it is preferred that the supporting device comprises a plastic, which can preferably be a thermoplastic or a polyamide. The use of PA6GFXX or PA6GF30 is very particularly preferred. In other words, the basic support can be formed from PA6GFXX. Here, the combination of letters XX preferably stands for glass fibers, which may be present in the material in different proportions. The use of PA6GFXX as a material for the supporting device makes it possible to provide a particularly robust and, at the same time, lightweight basic support for the dust hood extension device. Moreover, the materials PA6 or PA66 can be used in combination with glass fibers, for example, without being restricted thereto.

In a second aspect, the invention relates to a system for grinding chamfers which comprises a provided dust hood extension device. The system comprises at least one adapter, wherein the adapter has at least one surface for resting on a surface to be machined, and an opening, the size of which can be matched to a desired configuration of the chamfer to be ground. The terms, definitions and technical advantages introduced for the dust hood extension device preferably apply in analogous fashion to the provided kit.

According to the invention, it is preferred that the adapter is designed as a wearing part. This enables the adapter to be produced in a different way from, in particular less expensively than, the basic support of the provided dust hood extension device. In particular, the adapter can be produced with mass production methods, thus enabling it to be produced quickly, easily and in large quantities. This is made easier, in particular, by the fact that the adapter comprises polyoxymethylene (POM) or is formed from POM. According to the invention, it is preferred, in particular, if the adapter is produced from a tough thermoplastic or comprises such a thermoplastic. Adapters which comprise POM or are formed from POM have advantageously proven particularly wear-resistant and durable, while they nevertheless have the required sliding qualities for grinding applications. The use of POM as a material for the adapter makes it possible to provide a particularly lightweight adapter for the dust hood extension device, thus ensuring that the handling of the grinder is not made more difficult or is made only slightly more difficult by additional weight through the additional provision of the adapter. According to the invention, the use of POM is particularly preferred since POM is particularly wear-resistant. Moreover, POM has low friction values and a high toughness.

The use of the adapter as a wearing part advantageously leads to the possibility of using the dust hood extension device or basic support for longer or of having it available for a longer period of use. This is advantageous particularly because the dust hood extension device or basic support is subject to increased wear due to constant resting on and/or sliding along rough surfaces.

According to the invention, it is preferred that, in particular, the adapter has two bearing surfaces, by means of which the adapter or the dust hood extension device rests on the material to be ground. The two bearing surfaces are preferably referred to as the first bearing surface and as the second bearing surface. The two bearing surfaces of the adapter are preferably arranged substantially perpendicularly, i.e., orthogonally, to one another. During the grinding of the chamfer, three types of surface preferably occur: a) a vertical surface, which forms the front side of the staircase step when grinding chamfers on staircase steps, for example, b) a horizontal surface, which can form the upper side of a staircase step, for example, and c) an oblique surface, which connects the vertical front side and the horizontal upper side to one another and, in particular, forms the chamfer of the staircase step. According to the invention, it is preferred that the provided dust hood extension device rests by means of the first bearing surface of the adapter on the vertical front side of the staircase step to be ground, while the dust hood extension device rests by means of the second bearing surface of the adapter on the horizontal upper side of the staircase step to be ground. The oblique chamfer surface preferably forms an angle in the material of the staircase step with the vertical front side and the horizontal upper side of the staircase step, wherein the angle can assume an angle in a region of 135° in the case of a uniform chamfer. In the case of asymmetric chamfers, other angles can also be assumed between the chamfer and the two starting edges of the material to be machined.

The provision of the bearing surfaces preferably allows particularly easy and simple application and alignment of the adapter or the provided dust hood extension device to and with the corresponding edges, e.g., the vertical front side or the horizontal upper side during the grinding of a chamfer. It is thereby advantageously possible to achieve the production of a particularly uniform chamfer, which can then be further processed particularly well.

According to the invention, it is preferred that the grinding segment of the segmented ring is placed on the chamfer surface through the opening of the provided dust hood extension device or basic support or adapter. The opening of the adapter, which is preferably formed between the bearing surfaces of the adapter, can preferably be of different sizes.

According to the invention, it is preferred that the adapter is of one-piece design, thus enabling different sizes of opening to be provided by means of different adapters. According to the invention, it may also be preferred, however, if different sizes of the adapter opening could be achieved by means of a sliding mechanism. In this preferred embodiment of the invention, part of the adapter can be of movable and, in particular, slidable design. For example, the adapter part of movable design can be pushed into an opening of the basic support. For this purpose, the basic support can have an opening to receive the movable part of the adapter, for example. It is preferably possible, by sliding the movable adapter component, to modify the opening in such a way that it can be made larger or smaller.

The provided system can preferably have more than one adapter and can thus, for example, be sold as a kit which includes a dust hood extension device and a plurality of adapter devices. In this case, the different adapters can allow the grinding of chamfers of different widths, for example. For this purpose, the adapter, which is connected to the dust hood extension device during the operation of the grinder, can be exchanged in a particularly easy and uncomplicated manner. Moreover, an adapter device matched to the width of the chamfer to be produced can be used. The different adapters can differ particularly in the size of their opening, wherein it is possible, in particular, for the size of the opening to be matched to the width of the chamfer to be produced.

In one embodiment of the invention, it is preferred that the adapter comprises a clip for tool-free fastening on the dust hood. According to the invention, it is preferred that the clip for tool-free fastening of the adapter to the dust hood is arranged above the second bearing surface, that is to say, for example, above the horizontal surface of a staircase step, when the grinder is in use in order to produce a chamfer on a staircase step. The clip for tool-free fastening of the provided dust hood extension device or basic support on the dust hood is preferably also arranged above the second bearing surface of the adapter. The above statements relating to the preferably flexible nature of the clip material preferably apply similarly to the adapter clip.

In one embodiment of the invention, it is preferred that the system is of vertically adjustable design. According to the invention, this means, in particular, that the provided kit or system comprising the dust hood extension device and the adapter is of vertically adjustable design in relation to the grinding means used. In other words, the kit comprising the basic support and the adapter can be adjusted in height for fine adjustment in relation to the inserted tool, e.g., the segmented ring. Particularly effective removal of the dust formed during grinding with different grinding means and different degrees of wear of the grinding means is thereby ensured.

In another embodiment of the invention, it is preferred that a size of the chamfer to be ground is between 5 and 200 mm, preferably between 10 and 100 mm. This is advantageously achieved by providing adapters with openings of different sizes. According to the invention, it is very particularly preferred that a size of the opening of the adapter is in a range of from 5 to 200 mm, preferably in a range of from 10 to 100 mm. It is thereby advantageously possible to cover a particularly wide range of chamfer sizes. However, other adapter openings are also conceivable, depending on the nature and geometry or size or the grinding means used.

Further advantages will become apparent from the following description of the figures. Various exemplary embodiments of the present invention are illustrated in the figures. The figures, the description and the claims contain numerous features in combination. A person skilled in the art will expediently also consider the features individually and combine them to form expedient further combinations.

In the figures, identical components and components of identical type are designated by the same reference signs.

DETAILED DESCRIPTION OF THE DRAWINGS

Figure 1:
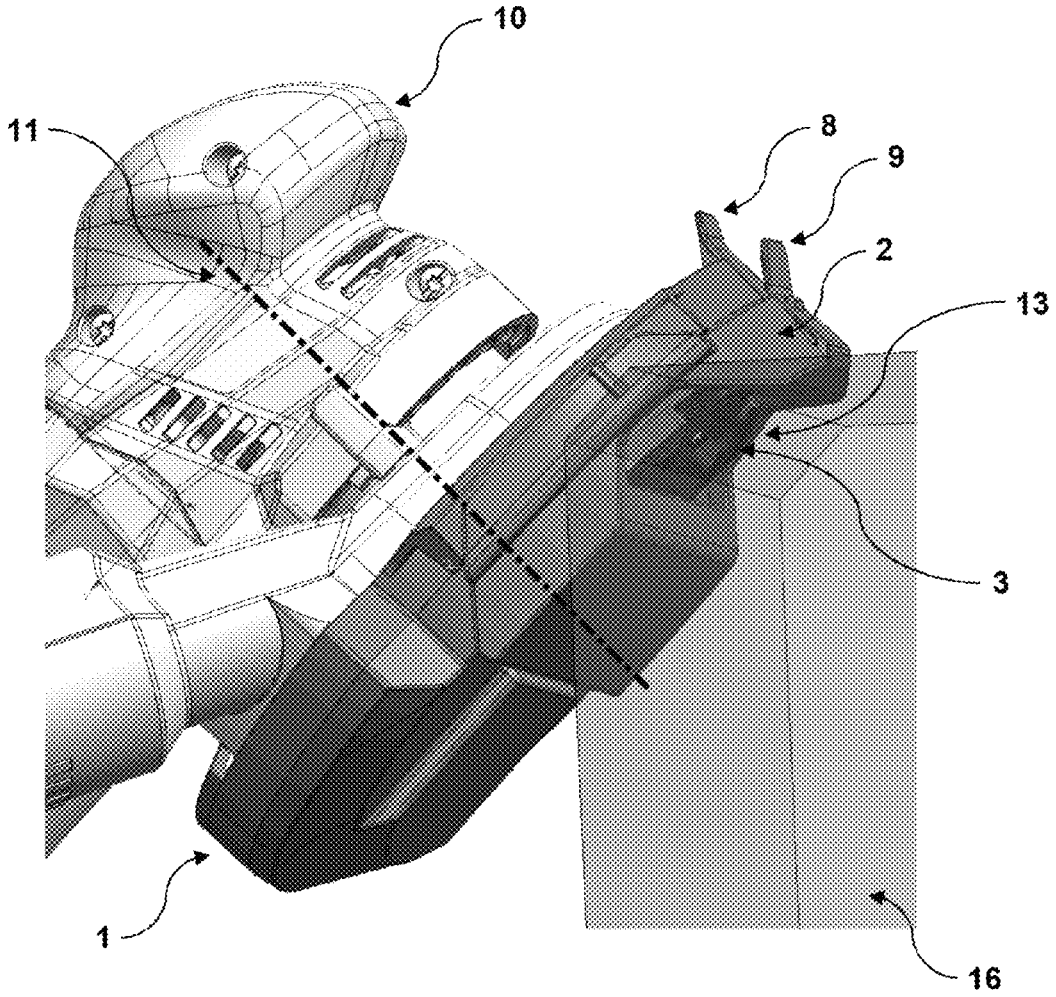
FIG. 1 shows a view of a preferred embodiment of the invention, in particular of a dust hood extension device.

FIG. 1 shows a preferred configuration of a provided dust hood extension device (4). FIG. 1 illustrates, in particular, the basic support (1) and the adapter (2) of a dust hood extension device (4) as well as the opening (3) of the supporting device (1) or the opening (13) of the adapter (2). FIG. 1 also illustrates the grinder (10) and the central axis (11) of the drive shaft. It can clearly be seen that the opening (3) of the basic support (1) is arranged eccentrically in relation to the rotation axis (11) of the grinder (10), with the result that, in particular, the opening (3 or 13) is arranged above the grinding means (5) or above a segment of the grinding means (5), which is preferably of annular design.

Arranged around the opening (3 or 13) are the bearing surfaces (6, 7) of the adapter (2), which are suitable for alignment of the dust hood extension device (4) in relation to the front side and the upper side of a material block (16) to be machined. The adapter (2) can be fastened on the dust hood (not illustrated) by means of a first clip (9), while the basic support (1) or dust hood extension device (4) can be fastened on the dust hood by means of a second clip (8). The first clip (9) is preferably referred to as an adapter clip, while the second clip (8) is referred to as a dust hood extension device clip. The clip devices (8, 9) are preferably arranged above the second bearing surface (6).

The first bearing surface (7) is preferably designed to align the dust hood extension device (4) in relation to a substantially vertically extending front side of the material block (16) to be machined. For this purpose, the dust hood extension device (4) can be placed by means of the first bearing surface (7) against the front side of the material block (16), e.g., a staircase step. Particularly tilt- and wobble-free working is thereby possible, with the result that particularly smooth work with the grinder (10) and the production of particularly uniform chamfers (15) is made possible through the provision of the bearing surfaces (6, 7). The second bearing surface (6) is preferably designed to align the dust hood extension device (4) in relation to a substantially horizontally extending upper side of the material block (16) to be machined. For this purpose, the dust hood extension device (4) can be placed by means of the second bearing surface (6) against the upper side of the material block (16), e.g., a staircase step.

Figure 2:
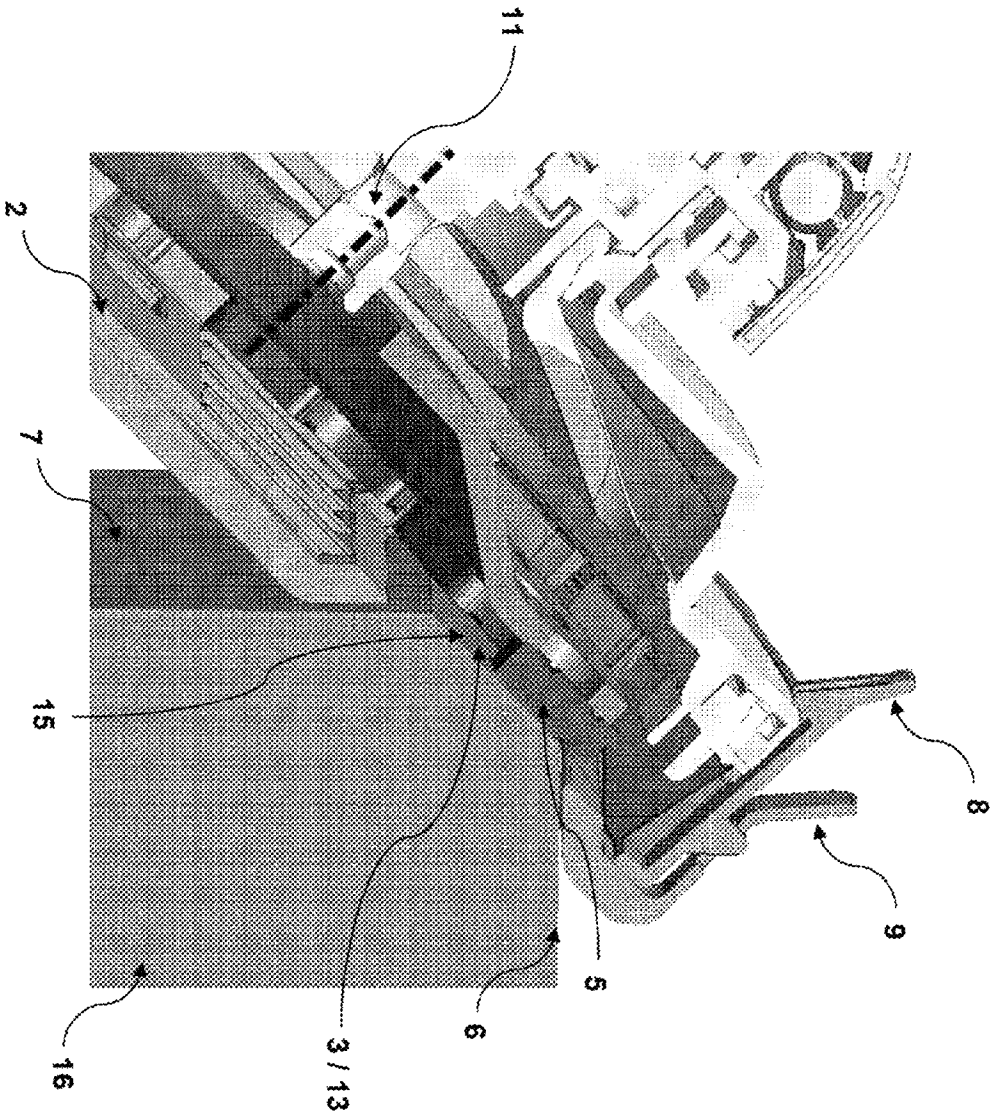
FIG. 2 shows a view of a preferred embodiment of the invention, in particular of a dust hood extension device.

The placement or alignment of the dust hood extension device (4) by means of the bearing surfaces (6, 7) on the side faces of a material block (16) is illustrated particularly well in FIG. 2. In particular, FIG. 2 also illustrates the central axis (11) of the drive shaft of the grinder (10), wherein this central axis (11) is preferably also referred to as the rotation axis. Moreover, it is possible to see in FIG. 2 how the grinding means (5) or a segment of the grinding means (5) rests on the chamfer (15) to be produced. The arrangement of the segment of the grinding means (5) preferably corresponds to the position of the openings (3, 13) of the basic support (1) or adapter (2) of the dust hood extension device (4).

Figure 3:
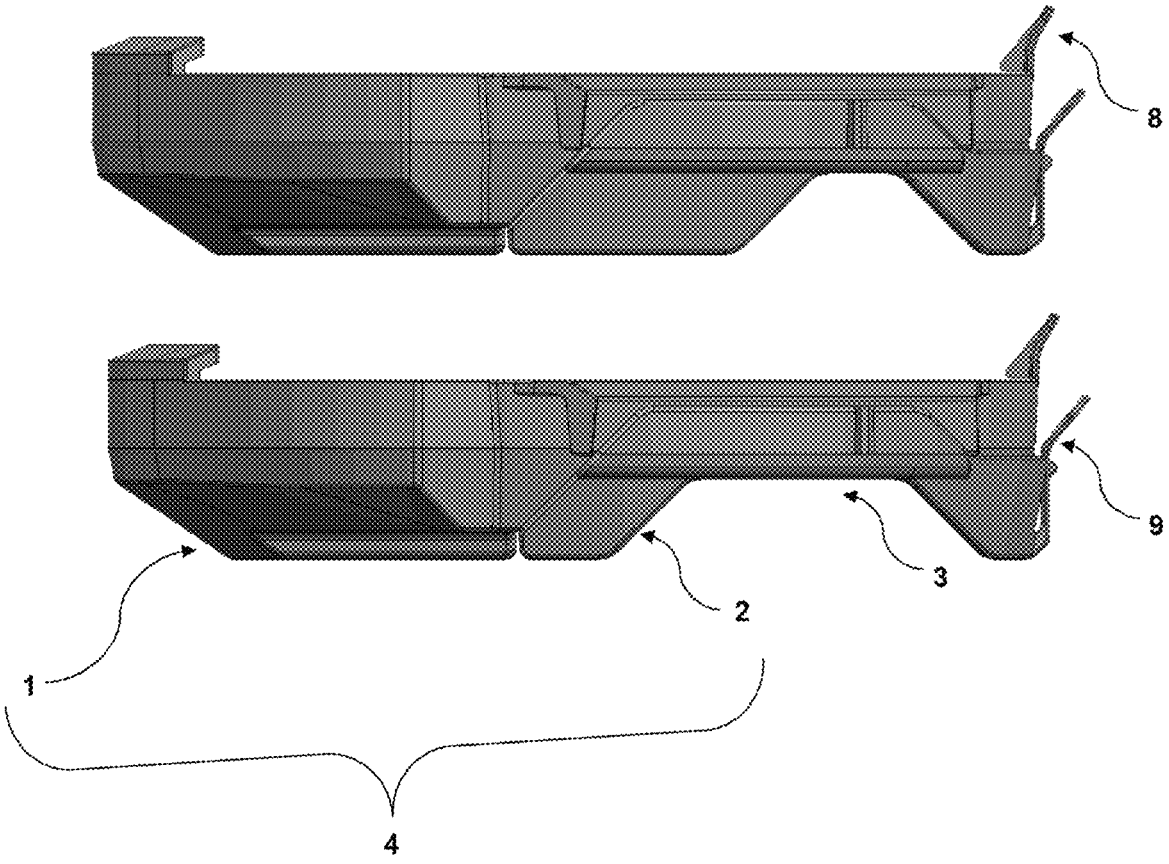
FIG. 3 shows a view of a preferred embodiment of the invention, in particular of a dust hood extension device, wherein the adapters illustrated have openings of different sizes.

FIG. 3 shows a preferred embodiment of the dust hood extension device (4), wherein, in particular, dust hood extension devices (4) with different adapters (2) are depicted. In particular, FIG. 3 shows adapters (2) which have openings (13) of different sizes, wherein the openings (13) are preferably at least partially delimited by the bearing surfaces (6, 7) of the adapter (2). In contrast, the opening (3) of the basic support (1) remains substantially unchanged. The openings (13) of different sizes in the adapter (2) enable the dust hood extension device (4) to be adapted to different sizes of chamfer (15) to be produced. This is made easier by the fact that the adapter (2) is preferably designed as a wearing or interchangeable part, thus making it possible to use different adapters (2) in combination with the provided dust hood extension device (4) when grinding chamfers (15) of different widths.

Figure 4:
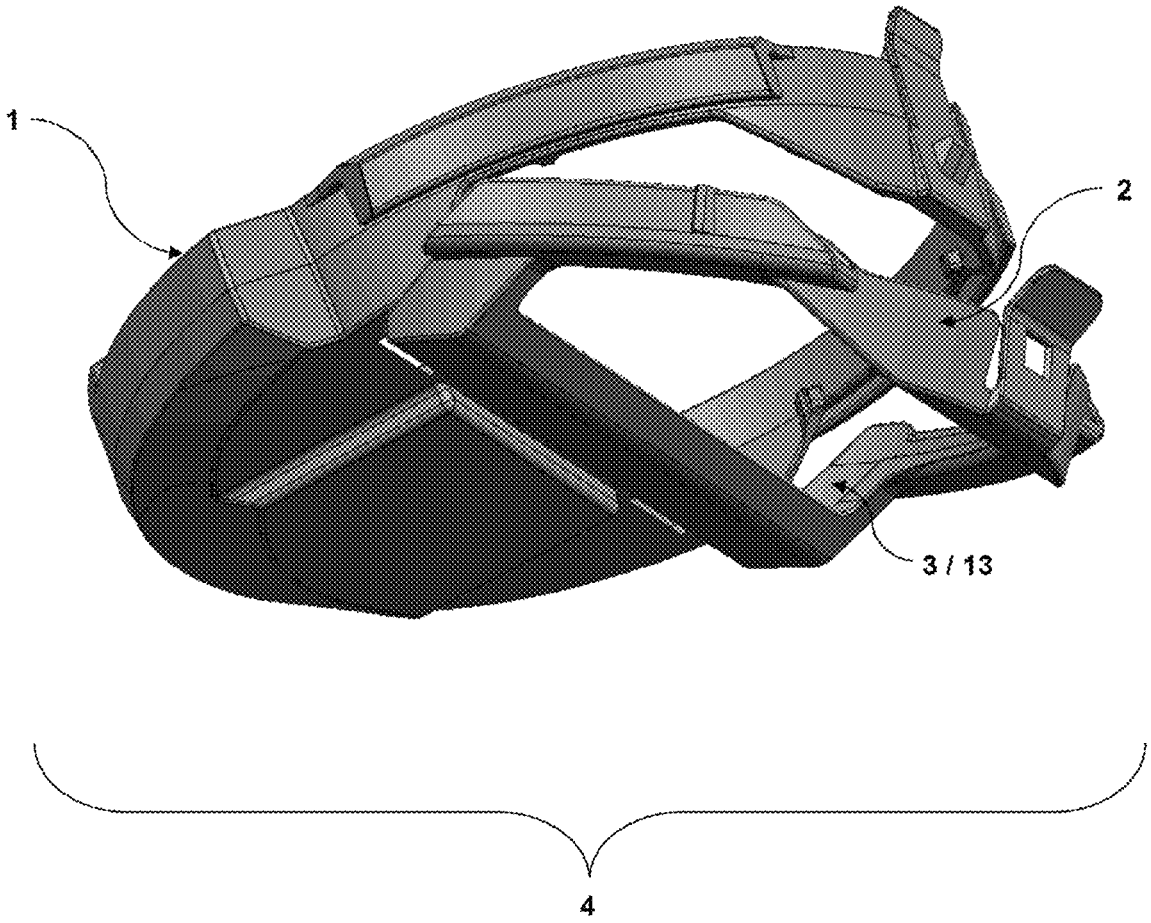
FIG. 4 shows a view of a preferred embodiment of the invention, in particular of a basic support and of an adapter of a dust hood extension device.

FIG. 4 shows a possible embodiment of an adapter (2) and of a basic support (1) in a preferred embodiment of a dust hood extension device (4) relative to one another. In particular, FIG. 5 illustrates how the adapter (2) can be mounted on the basic support (1). According to the invention, it is particularly preferred that the adapter (2) is hooked into the basic support (1) in a rear region and is clipped into the basic support (1) using a clip mechanism in a front region.

LIST OF REFERENCE CHARACTERS

1 Basic support/supporting device
2 Adapter
3 Opening
4 Dust hood extension device
5 Grinding means or grinding segment of a grinding means
6 Second bearing surface
7 First bearing surface
8 Clip (dust hood extension device)
9 Clip (adapter)
10 Grinder
11 Rotation axis or central axis of the drive shaft
13 Opening of the adapter
15 Chamfer or chamfer surface
16 Material to be machined or material block

What is claimed is:

1. A system, comprising:

a dust hood extension device for use with a dust hood of a grinder, wherein the grinder comprises a drive shaft for driving a grinding means and wherein the grinding means is rotatable in a rotationally symmetrical manner around a central axis of the drive shaft during operation, the dust hood extension device comprising:

a supporting device, wherein the supporting device is ring-shaped and is configured to surround the dust hood and to collect dust particles which emerge from grinding of a material block by the grinding means of the grinder during the operation; and a first opening defined by the supporting device, wherein the first opening is arranged eccentrically with respect to the central axis of the drive shaft in a fastened condition of the dust hood extension device on the dust hood of the grinder; and an adapter detachably mounted on the supporting device, wherein the adapter has a first bearing surface for resting on a first surface of a chamfer on the material block and a second bearing surface for resting on a second surface of the chamfer on the material block, wherein the first bearing surface and the second bearing surface are disposed perpendicularly to one another, and wherein the adapter has a second opening, wherein a size of the second opening is matchable to a configuration of the chamfer and wherein the second opening of the adapter is aligned with the first opening of the supporting device and has a different size than the first opening of the supporting device.

2. The system as claimed in claim 1 wherein the dust hood extension device further comprises a second clip and wherein the second clip is fastenable on the dust hood without use of a tool.

3. The system as claimed in claim 1, wherein the supporting device is rotatably mountable on the dust hood.

4. The system as claimed in claim 1, wherein the supporting device is a thermoplastic.

5. The system as claimed in claim 1, wherein the adapter is a wearing part.

6. The system as claimed in claim 1, wherein the adapter has a first clip and wherein the first clip is fastenable on the supporting device.

7. The system as claimed in claim 1, wherein the system is vertically adjustable with respect to the grinding means of the grinder in a fastened condition of the system on the grinder.

8. The system as claimed in claim 1, wherein the size of the second opening is in a range of from 5 to 200 mm.

* * * * *